US007144492B2

(12) United States Patent
Becker et al.

(10) Patent No.: US 7,144,492 B2
(45) Date of Patent: Dec. 5, 2006

(54) ASSEMBLY COMPRISED OF JOINED CONDUCTIVE COMPONENTS HAVING CATAPHORETIC PAINT LAYER AND PROCESS FOR MANUFACTURE THEREOF

(75) Inventors: Wolfgang Becker, Ulm (DE); Alfred Fuchs, Rottenburg (DE); Klaus Goth, Sindelfingen (DE); Markus Knoeller, Nagold (DE); Dirk Lindenau, Stuttgart (DE); Claus-Dieter Reiniger, Remshalden (DE); Daniel Zauner, Ballendorf (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 11/140,036

(22) Filed: May 27, 2005

(65) Prior Publication Data

US 2005/0266264 A1 Dec. 1, 2005

(30) Foreign Application Priority Data

May 27, 2004 (DE) ..... 10 2004 025 931.3

(51) Int. Cl.
*B05D 3/02* (2006.01)
*B05D 3/14* (2006.01)
*B23K 26/00* (2006.01)

(52) U.S. Cl. ..... 205/317; 205/205; 205/320; 219/121.85; 427/239

(58) Field of Classification Search ..... 205/205, 205/316, 317, 320; 427/239; 219/121.6, 219/121.65, 121.73, 121.82, 121.85
See application file for complete search history.

(56) References Cited

U.S. PATENT DOCUMENTS 3,838,495 A * 10/1974 Kuhnert ..... 29/458

FOREIGN PATENT DOCUMENTS

| | | |
|---|---|---|
| DE | 44 07 170 A1 | 9/1995 |
| DE | 196 14 328 A1 | 10/1997 |
| JP | 11047967 A | 2/1999 |
| WO | WO 99/08829 A1 | 2/1999 |

* cited by examiner

*Primary Examiner*—Michael E. LaVilla
(74) *Attorney, Agent, or Firm*—Akerman & Senterfitt; Stephan A. Pendorf

(57) ABSTRACT

The application of anti-corrosion base coating by cataphoretic painting (KTL) is well known in manufacturing automobile body parts. However the cataphoretic paint can penetrate only incompletely or possibly not at all into the gap in the contact areas of the components joined to each other. This type of gap is conventionally scaled following cataphoretic painting, in order to ensure corrosion protection for the entire assembly. The present invention makes it possible to dispense with the sealing in the production of an assembly of joined conductive components and nevertheless to ensure a sufficient corrosion protection. By introducing topographic changes in the components projecting from their surface in the known contact areas and then joining these components, they are spaced apart by the projecting topographic changes in such a manner that during cataphoretic painting the paint wets the entire surface of the assembly.

4 Claims, No Drawings

ASSEMBLY COMPRISED OF JOINED CONDUCTIVE COMPONENTS HAVING CATAPHORETIC PAINT LAYER AND PROCESS FOR MANUFACTURE THEREOF

BACKGROUND OF THE INVENTION

1. Field of the Invention

The invention concerns an assembly comprised of joined conductive components coated with cataphoretic paint, and a processes for production thereof. A process of this general type is already known from DE 44 35 050 A1.

2. Related Art of the Invention

The application of anti-corrosive base coats by cataphoretic painting (KTL) is known to those working in automobile body production. An example thereof can be found in DE 44 35 050 A1. However, a narrow gap occurs, in particular in the contact area of joined components, in which the cataphoretic coating can penetrate only incompletely, or not at all. For this reason this type of gap is conventionally treated with a sealant following KTL, in order to ensure a corrosion protection for the total assembly. This type of sealing material behaves highly variably and frequently unpredictably with respect to it's adhesion to the KTL coated and not coated assembly surfaces, and thus, a checking of adhesiveness is an indispensable part of quality control. Both the sealing as well as the adhesion checking involve supplemental process steps, which are associated with supplemental costs.

In the case of pre-coated sheet metal, in particular zinc coated sheet metal as likewise used in the automobile industry, the coating material has a significantly lower boiling point than the melting point of the sheet metal material. Thereby, during welding of this type of sheet metal, explosion like vaporization of coating material can occur at the overlap joint, which strongly compromises the quality of the joint.

For improving the joining quality it has already been proposed to use spacers to produce a narrow gap between the sheets, in order to allow the vaporized coating material to escape. As spacers, suitable topographic changes of the sheet metal can be produced by laser impacting of the surface according to DE 10241593 A1.

SUMMARY OF THE INVENTION

The task of the present invention is thus comprised of reducing the number of process steps for the production of an assembly of joined conductive components, in particular with which the sealing step can be omitted.

DETAILED DESCRIPTION OF THE INVENTION

With regard to the process to be provided for corrosion protection of an assembly of conductive components joined to each other by cataphoretic painting (KTL), the task is inventively solved thereby, that topographical changes projecting from the surface are produced on the components at their known contact areas, that the components are joined, wherein they are spaced apart by the projecting topographic changes in such a manner that during the cataphoretic painting the paint wets the entire surface of the assembly.

The contact area is known beforehand either from simulation or by empirical examination. The term "contact area" is used herein to refer to both the areas of solid joining, that is, welding areas, as well as also assembly areas, in which the individual components due to their geometry, arrangement or possibly their state of stress lie close to each other in such a manner that cataphoretic painting is impeded.

The introduced topographical changes provide in the contact area a sufficient accessibility to all component surfaces in such a manner that during cataphoretic painting the cataphoretic paint reaches all, that is, also the inner surfaces of the assembly, and wets these and therewith provides effective corrosion protection. A subsequent sealing is thus likewise dispensable, as well as the checking of adhesiveness.

According to an advantageous embodiment of the inventive process the topographic changes are introduced in the component surfaces by laser scanning or exposure.

A process of this type is particularly rapid and efficient for introduction of topographic changes, as can be seen from application DE 10241593 A1 of the present applicants. Thus, with respect to particularly advantageous embodiments, reference is explicitly made to DE 10241593 A1.

The laser radiation is particularly advantageous both for introduction of the topographic changes in the component surfaces as well as for joining of the components to the assembly. This can occur for example by means of a scanner device.

It is likewise however also possible to mechanically introduce the topographic changes in the components, for example by stamping, and to join the components thereafter by gluing and subsequently to impart corrosion protection by cataphoretic painting.

According to a particularly advantageous embodiment of the inventive process the topographic changes are produced by laser radiation, in that the laser carries out movement with transverse and longitudinal components through and/or around the center of its processing or effective surface.

The advantage of this embodiment is comprised therein, that a movement of the laser beam occurs within the effective zone of the melt and excites this thereby in addition to the heat induced mixing or quasi-stirs this. This leads thereto, that the resulting topographic changes are shaped more rounded at their tips, that is, exhibit a tip radius, which is greater than the height of the topographic changes. This type of topographic change is more suited as spacer than those previously known, since on the basis of their "roundness" they are less prone to being pressed into the spaced sheet metal or being deformed themselves, and thus less undesired deviations occur in the sheet metal. Besides this, even with thin sheets no indications of the topographic changes appear on the side opposite to the sheet metal being spaced apart.

With regard to the assembly to be produced of joined conductive components which have a cataphoretic painted corrosion protective layer, this task is inventively solved thereby, that the components exhibit on their contact areas topographic changes projecting from their surface, which space them apart, and that the cataphoretic paint coats the entire surface of the assembly.

The advantage of such an assembly is comprised therein, that a supplemental sealing of the assembly and the checking of the surface can be dispensed with.

According to an advantageous embodiment of the inventive assembly the topographic changes exhibit a tip radius which is greater than the height of the topographic changes. This spherical shape ensures the above described advantages.

The topographic changes exhibit generally a height of at least 100 μm, preferably 200 to 400 μm, in exceptional cases topographic changes with a height of approximately 1 mm can be produced. The topographic changes exhibit among themselves preferably a spacing of 3 to 30 mm, particularly preferably 5 to 20 mm. Single topographic changes are also possible.

This type of topographic changes ensures a sufficient accessibility for any cataphoretic painting system.

In the following the inventive process and the inventive assembly is described in greater detail on the basis of two illustrative embodiments:

According to a first illustrative embodiment multiple components are joined into an assembly of a motor cradle. There, the contact areas are known already from many years of practical experience.

The components are gripped by a gripping device and positioned in front of a laser scanner device. The laser scanner device steers a laser beam sequentially to multiple processing surfaces within the contact area. The scanner device is comprised of a two dimensional pivotable computer-controlled mirror system. The scanner device exhibits approximately 320 mm distance to the surface of the components, the laser focus is approximately 20 mm in front of the surface. The scanner device directs or guides the laser beam with a processing speed of 1.25 m/min upon a machining or working surface. On the last micrometers prior to reaching the actual processing surface the laser output is increased within a time frame of 5 ms to a work output of 3.5 kW. Thereafter, for producing the topographic changes, the scanner device guides the laser beam circularly over the coated sheet metal surface. The circle has a diameter of 0.13 mm. For the processing thereof 25 ms are needed. After carrying out the circular track the scanner device guides the laser beam to the next processing surface. After leaving the actual processing surface the laser output is again reduced within a time frame of 5 ms to a predetermined value. By the circular movement of the laser beam within the interaction zone of the melt, that is, a movement with lateral and longitudinal components, the melt is excited or quasi-stirred supplementally to the mixing induced by the warming. This leads thereto, that the resulting topographical change exhibits on its tip a dome shape, that is, it exhibits a tip radius which is greater than the height (150 μm) of the topographic change. This is supported by the defocusing of the laser beam, since thereby the warming of the processing or work surface occurs more planar and more even. From this there results the formation of a topographical change in the shape of an even-contoured peak in a shallow recess in the component.

This type of topographical change is evenly distributed over the entire contact surface of a component with a spacing of 10 mm. On the corresponding contact surface of the oppositely lying component no topographical changes are needed, in order to ensure the maintenance of a minimum gap.

The individual components are positioned relative to each other, clamped and joined by welding into an assembly. For this the topographical changes ensure accessibility to all surfaces, in particular the inner surfaces of the assembly. Thereafter a cataphoretic painting occurs. The paint wets the entire surface of the assembly, since the minimum spacing of the components is ensured overall, which enables the access to the paint. The sealing of the assembly which otherwise always occurs can be dispensed with.

According to a second illustrative embodiment topographic changes are stamped into the component. The component exhibits, in the areas of contact with the second component, a sheet metal thickness of 0.8 mm. The topographic changes are produced by the pressing-in of steel needles into the sheet. Thereby topographic changes projecting from the component opposite side with a height of 300 μm are produced.

The component is adhered, with an additional component, into an assembly and can be subjected to cataphoretic painting. Here also the otherwise conventional sealing of the assembly can be dispensed with.

The inventive process and the inventive assembly have proven themselves, in the embodiments according to the above described examples, as particularly suited for corrosion protection in the automobile industry. In particular thereby also substantial advantages with regard to processing time can be achieved.

The invention is not limited to the above described illustrative examples, but rather is broadly applicable.

Thus for example the topographic changes can be introduced after positioning of the components relative to each other in a so called "pass through" or "shoot through" mode of the laser scanner in one or more components of the assembly. Thereby a further process acceleration can be achieved.

In this "shoot through" mode the topographical changes are produced on the side of the component opposite to the laser beam.

If an assembly is required to have large hollow spaces, then by suitable introduction of holes or gullies in one or more components or their contact areas an escape of excess paint can be ensured.

Thereby on the one hand a comprehensive corrosion protection with low expenditure of paint is assured and on the other hand it is avoided that in later employment in the real world water can collect in these hollow spaces.

The invention claimed is:

1. A process for corrosion protection of an assembly of joined conductive components by cataphoretic painting, comprising:

producing topographic changes projecting from a surface of at least one component at a predetermined contact area of the joint components, joining components into the assembly such that the components are spaced apart by the projecting topographic changes in such a manner that during the cataphoretic painting paint wets entire surface of the assembly, and cataphoretic painting the assembly.

2. The process for corrosion protection according to claim 1, wherein the topographic changes are produced on the at least one component surface by laser scanning.

3. The process for corrosion protection according to claim 2, wherein the laser scanning is carried out by a laser scanner device guiding a laser beam moving transversely and longitudinally over processing surfaces within the contact area.

4. The process according to claim 3, wherein the laser beam moves circularly over processing surfaces within the contact area.

* * * * *